US012635790B1

(12) United States Patent
Snyder et al.

(10) Patent No.: US 12,635,790 B1
(45) Date of Patent: May 26, 2026

(54) TABLE WITH SPLIT SLIDING TOP AND CRAFT/GAMING SURFACE

(71) Applicants: Wayne Harvey Snyder, Longmont, CO (US); Shawn Daniel Snyder, Longmont, CO (US)

(72) Inventors: Wayne Harvey Snyder, Longmont, CO (US); Shawn Daniel Snyder, Longmont, CO (US)

( * ) Notice: Subject to any disclaimer, the term of this patent is extended or adjusted under 35 U.S.C. 154(b) by 0 days.

(21) Appl. No.: 19/282,980

(22) Filed: Jul. 28, 2025

Related U.S. Application Data

(60) Provisional application No. 63/763,757, filed on Feb. 26, 2025.

(51) Int. Cl.
*A47B 3/12* (2006.01)
*A47B 25/00* (2006.01)

(52) U.S. Cl.
CPC ..... *A47B 3/12* (2013.01); *A47B 25/00* (2013.01)

(58) Field of Classification Search
CPC ..... A47B 3/12; A47B 25/00; A47B 13/088; A47B 13/081; A47B 13/16; A47B 1/10; A47B 1/05
USPC ..... 108/101, 143, 84, 86, 11, 62, 63, 13, 14, 108/25, 50.11, 90, 76; 273/280, 309; 473/10
See application file for complete search history.

(56) References Cited

U.S. PATENT DOCUMENTS 701,782 A * 6/1902 White
797,852 A * 8/1905 Hayden
1,755,062 A * 4/1930 Hernes ..... A47B 25/00 473/109
2,008,613 A * 7/1935 Hernes ..... A47B 25/00 108/77
2,030,655 A * 2/1936 Roch ..... A63D 15/04 473/10
2,102,449 A * 12/1937 Zimmerman ..... A47B 25/00 108/63
2,456,835 A * 12/1948 Nash ..... A47B 1/05 384/19
2,572,333 A * 10/1951 Greitzer ..... A47B 25/00 108/90

(Continued)

FOREIGN PATENT DOCUMENTS

DE 202024101955 U1 * 5/2024 ..... A47B 3/083
JP 06197814 A * 7/1994

(Continued)

*Primary Examiner* — Janet M Wilkens
(74) *Attorney, Agent, or Firm* — Cozen O'Connor

(57) ABSTRACT

A table includes a top surface formed of a first sliding top portion and a second sliding top portion and a craft/gaming surface. The first sliding top portion includes a first bearing plate at a first end and a second bearing plate at a second end, opposite the first end. The second sliding top portion includes a third bearing plate at a first end and a fourth bearing plate at a second end opposite the first end. A table also includes a first end assembly having two legs and a first cross-member forming a first guide and a second end assembly having another two legs and a second cross-member forming a second guide. Two bearings on each of the bearing plates follow a corresponding one of the first and second guides to allow the first and second sliding tops to independently slide and rotate for storage beneath the table.

13 Claims, 12 Drawing Sheets

(56) References Cited

U.S. PATENT DOCUMENTS

| | | | | | |
|---|---|---|---|---|---|
| 4,061,091 | A * | 12/1977 | Goyvaerts | A47B 1/05 108/84 |
| 2010/0026151 | A1* | 2/2010 | Melkumyan | B62B 3/005 312/249.11 |
| 2020/0037756 | A1* | 2/2020 | Lord | A47B 13/081 |
| 2024/0285065 | A1* | 8/2024 | Wang | A47B 1/05 |

FOREIGN PATENT DOCUMENTS

| | | | | | |
|---|---|---|---|---|---|
| KR | 20180009063 | A * | 1/2018 | A47B 1/02 |
| KR | 20220022997 | A * | 3/2022 | A47B 13/003 |

* cited by examiner

TABLE WITH SPLIT SLIDING TOP AND CRAFT/GAMING SURFACE

RELATED APPLICATION

This application claims priority to U.S. patent application Ser. No. 63/763,757 titled "Table With Split Sliding Top and Craft/Gaming Surface," filed Feb. 26, 2025 and incorporated herein in its entirety.

BACKGROUND

Conventional two-surface tables require that a top surface is lifted off to access a second surface, requiring that the top surface be stored elsewhere when not in use. This is inconvenient and risks damage to the top surface.

SUMMARY

The present embodiments overcome the above problems with prior art tables by including a bearing mechanism that allows the top surface to split and slide underneath a second surface of the table.

In certain embodiments, the techniques described herein relate to a table with a split sliding top and a craft/gaming surface, including: a first end assembly having two legs and a first cross-member, the first cross-member forming a first guide; a second end assembly having two legs and a second cross-member, the second cross-member forming a second guide; a table bottom mounted between the first end assembly and the second end assembly to form the craft/gaming surface; a first sliding top portion having a first bearing plate and a second bearing plate attached at opposite ends of the first sliding top portion; and a second sliding top portion having a third bearing plate at a first end of the second sliding top portion and a fourth bearing plate at a second end of the second sliding top portion that is opposite to the first end; wherein two bearings on each of the first bearing plate and the second bearing plate extend into a corresponding one of the first guide and the second guide and guide the first sliding top and the second sliding top to independently transition the table between use with the split sliding top and the craft/gaming surface.

BRIEF DESCRIPTION OF THE FIGURES

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE EMBODIMENTS

In the following description, certain specific details are set forth in order to provide a thorough understanding of various disclosed embodiments. However, one skilled in the relevant art will recognize that embodiments may be practiced without one or more of these specific details, or with other methods, components, materials, etc. Unless the context requires otherwise, throughout the specification and claims which follow, the word "comprise" and variations thereof, such as, "comprises" and "comprising" are to be construed in an open, inclusive sense that is as "including, but not limited to."

Reference throughout this specification to "one implementation" or "an implementation" or "one embodiment" or "an embodiment" means that a particular feature, structure or characteristic described in connection with the embodiment is included in at least one implementation or embodiment. Thus, the appearances of the phrases "one implementation" or "an implementation" or "in one embodiment" or "in an embodiment" in various places throughout this specification are not necessarily all referring to the same implementation or embodiment. Furthermore, the particular features, structures, or characteristics may be combined in any suitable manner in one or more implementations or one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Figure 1:
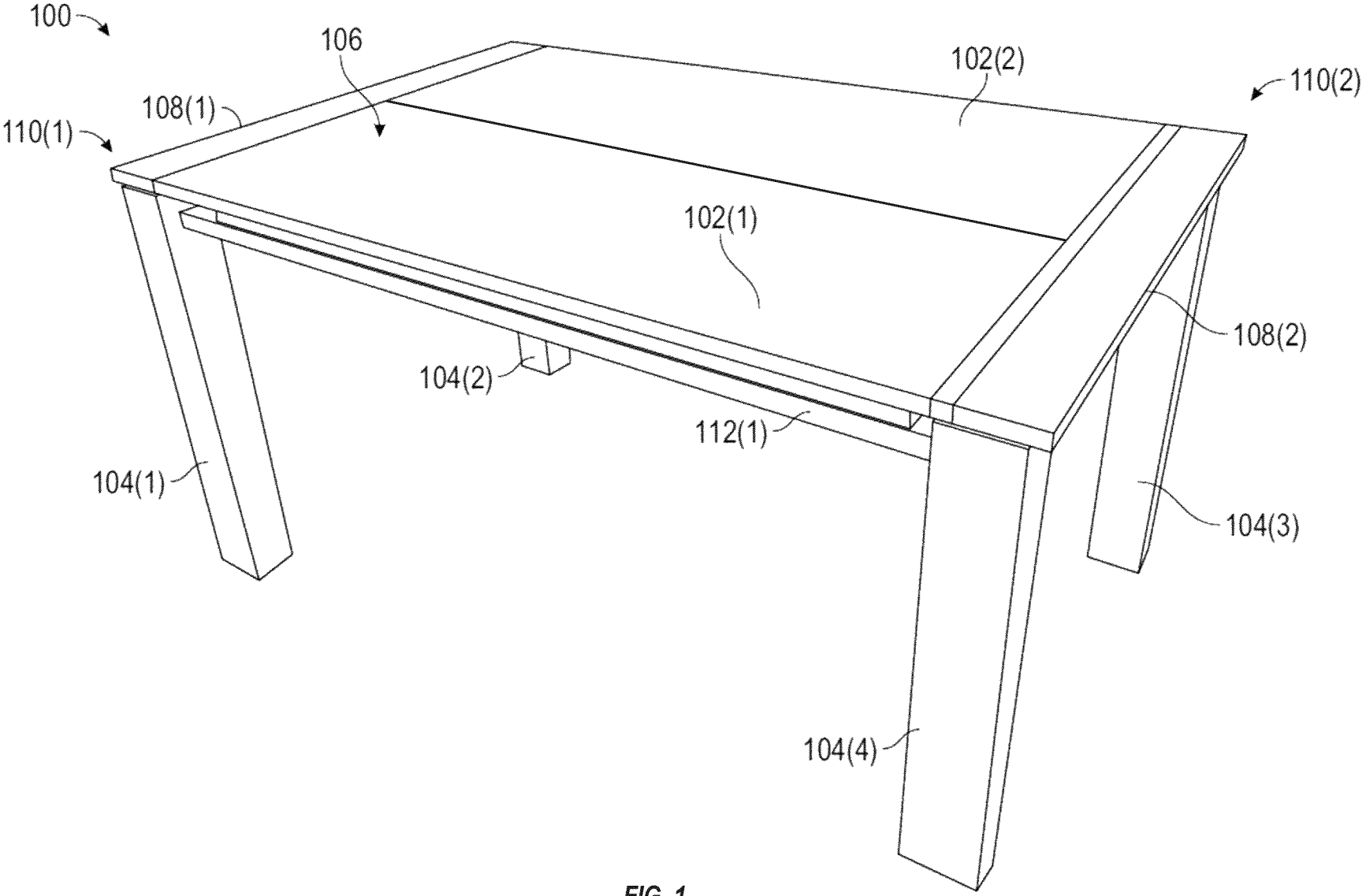
FIG. 1 is an isometric diagram showing one example table with two sliding top portions (1) and (2) that form a split top surface that covers a craft/gaming surface, in embodiments.

FIG. 1 is an isometric diagram showing one example table 100 with two sliding top portions 102(1) and 102(2) that form a split top surface 106 that covers a craft/gaming surface, in embodiments. In this configuration, table 100 appears and functions as a conventional table and includes four legs 104(1)-(4) that support a substantially flat top surface 106. Legs 104(1) and 104(2) couple with a first cross-member 108(1) to form a first end assembly 110(1) and legs 104(3) and 104(4) couples with a second cross-member 108(2) to form a second end assembly 110(2). Each of first cross-member 108(1) and second cross-member 108(2) may be formed of multiple components (e.g., wooden parts) that couple together. First end assembly 110(1) and second end assembly 110(2) are coupled together by two frames 112 (only frame 112(1) is shown in FIG. 1) formed of angle iron. When top portions 102 form top surface 106, top portions 102 rest, at least in part, on base-sides 206 and bearings 412 (see FIGS. 2 and 4 described below).

Figure 2:
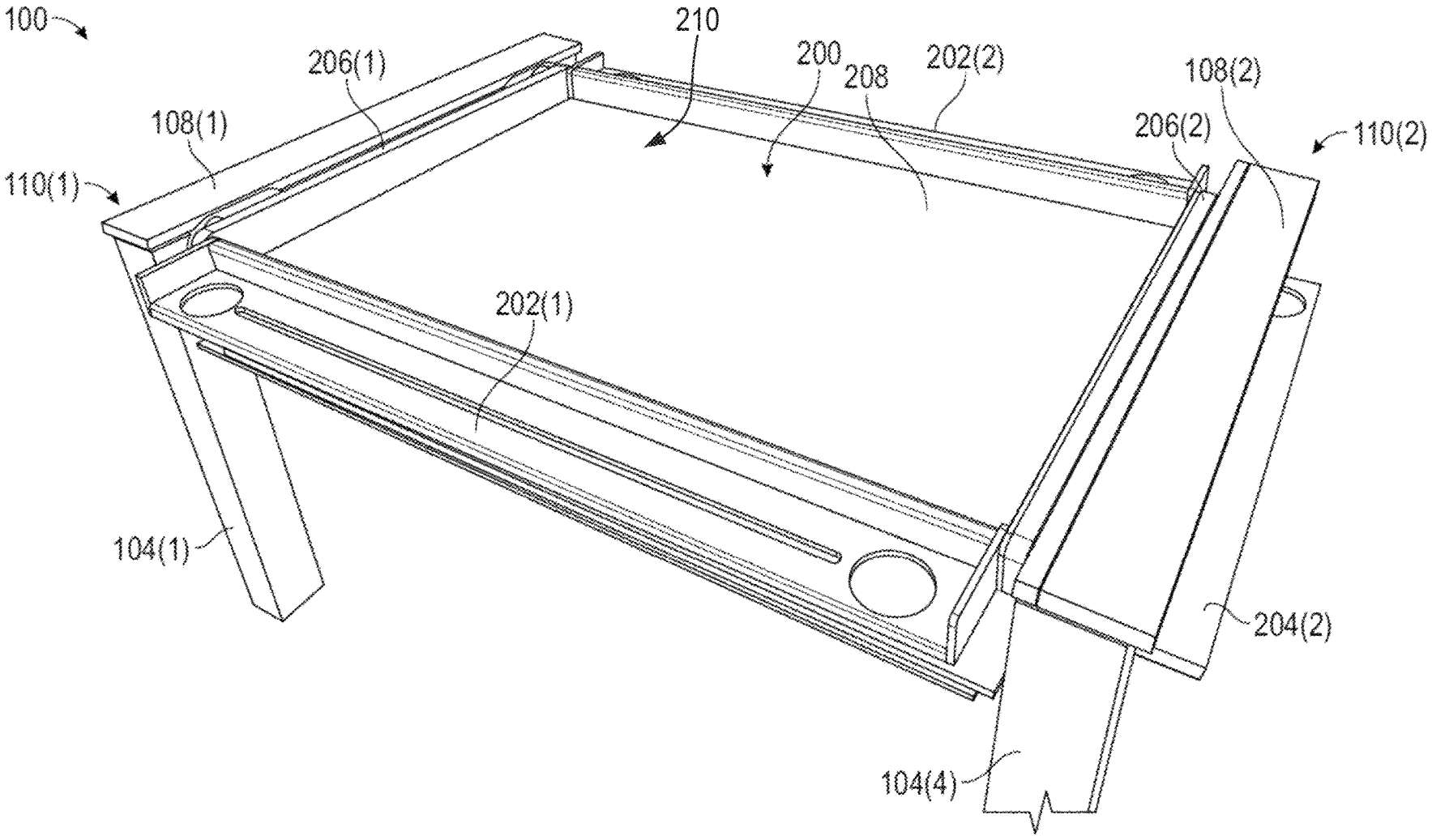
FIGS. 2 and 3 are isometric diagrams illustrating table of FIG. 1 in a second configuration sliding top portions in a storage position to reveal a craft/gaming surface implemented by a table bottom, in embodiments.
Figure 3:
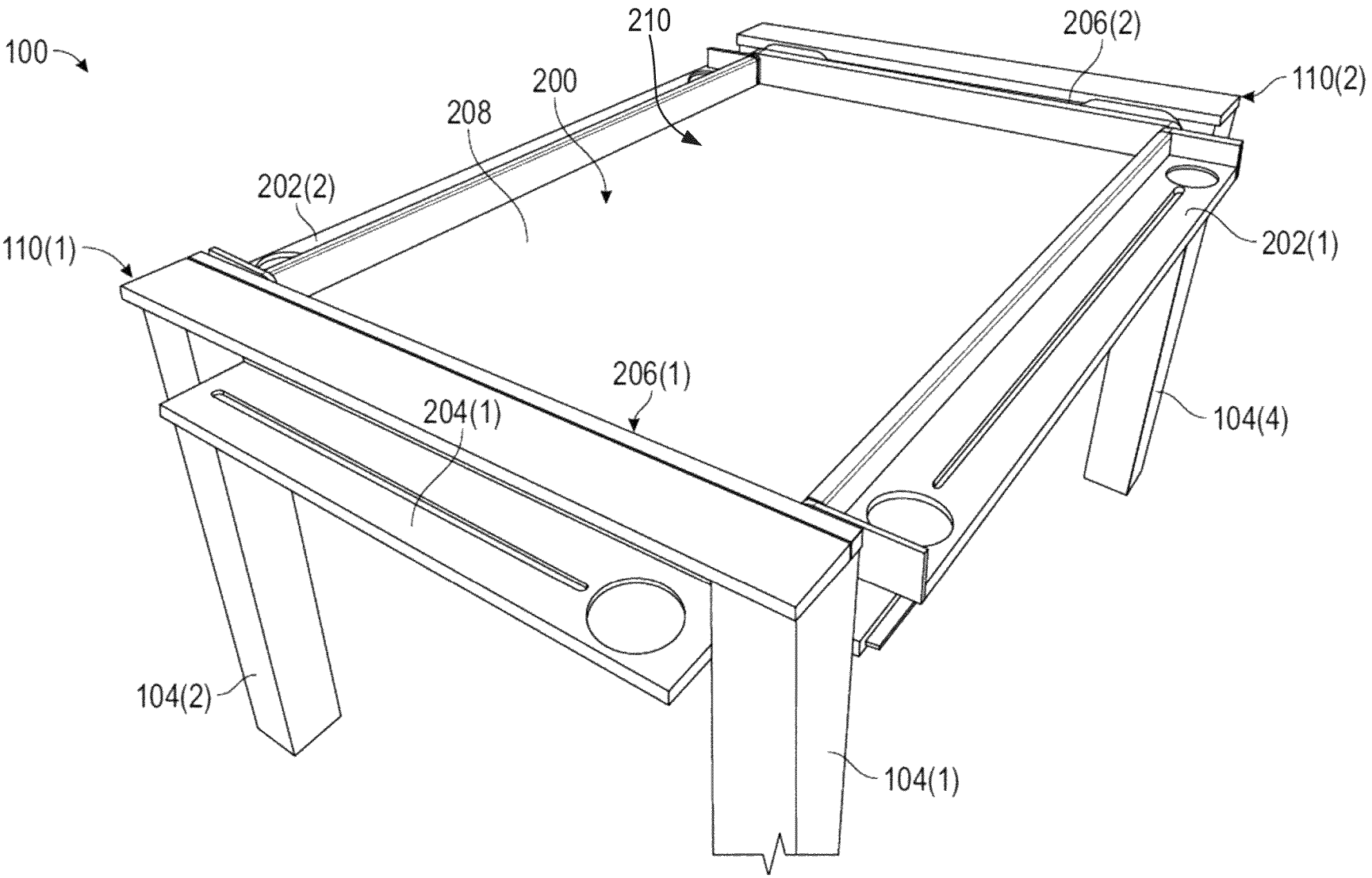

FIGS. 2 and 3 are isometric diagrams illustrating table 100 of FIG. 1 in a second configuration, where sliding top portions 102(1) and 102(2) are slid into a storage position (e.g., see storage position 900 of FIG. 9) to reveal a craft/gaming surface 200 implemented by a table bottom 208. In this configuration, table 100 may include two side trays 202(1) and 202(2) and/or two end trays 204(1) and 204(2) that are hinged and unfold outwards to provide additional table areas for holding drinks, cards, pencils, and other implements. In certain embodiments, table bottom 208 is formed as a single piece.

Advantageously, table 100 has two table tops (e.g., top surface 106 formed by sliding top portions 102 and craft/gaming surface 200 formed by table bottom 208) with a sliding mechanism that allows sliding top portions 102(1) and 102(2) to independently slide up, outwards, and rotate and slide underneath table 100 into the storage position. Table 100 thereby provides two table surfaces 106 and 200 in a single space, offering double use to save space and increase utility of a room, where top portions 102 are retained and stored with table 100. Further, items may remain on craft/gaming surface 200 when top surface 106 is in use, since there are a few inches of storage space 210 between an underside sliding top portions 102 and craft/gaming surface 200, and unfinished activities may remain on craft/gaming surface 200 (e.g., within storage space 210) when using top surface 106.

Table 100 also includes two base-sides 206(1) and 206(2) that couple with frames 112 to form a rectangular support for table bottom 208. Base-sides 206(1) and 206(2) and table bottom 208 are notched to receive frame frames 112. Frames 112 run the length of table 100 and are fixed to end assemblies 110, thereby strengthening both table bottom 208 and legs 104. Particularly, fasteners (e.g., bolts and/or screws) secure an upright portion of frames 112 to legs 104, thereby making legs 104 more rigid and maintaining legs 104 perpendicular to table bottom 208.

Figure 4:
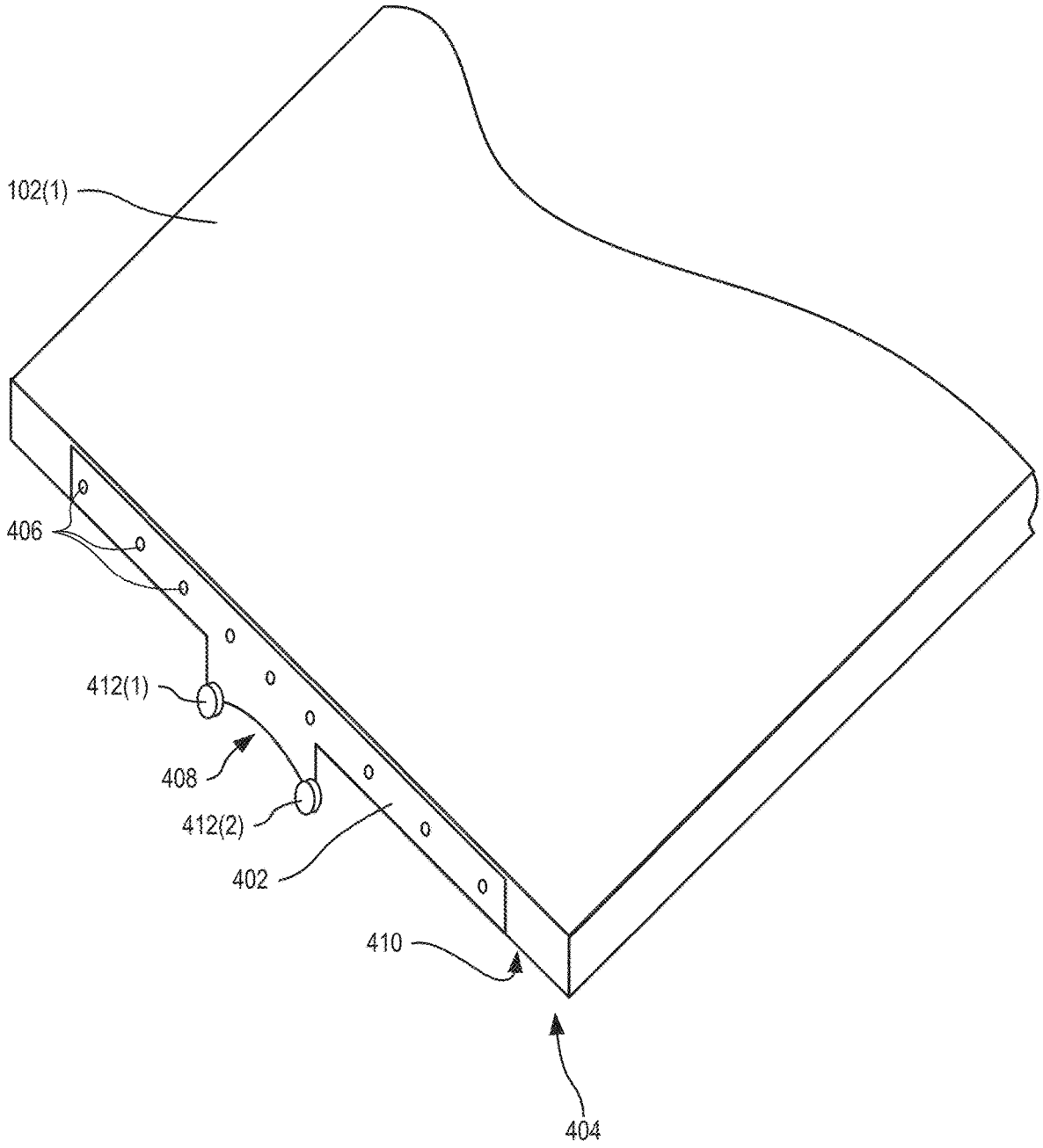
FIG. 4 is an isometric diagram illustrating one example bearing plate fitted to one end of sliding top portion of FIG. 1 by a plurality of fasteners applied through apertures, in embodiments.

FIG. 4 is an isometric diagram illustrating one example bearing plate 402 fitted to one end 404 of sliding top portion 102(1) of FIG. 1 by a plurality of fasteners applied through apertures 406, in embodiments. A second end (not shown) of sliding top portion 102(1) is fitted with a second bearing plate, similar to bearing plate 402, and each end of sliding top portion 102(2) is also fitted with a similar bearing plate. FIGS. 5A-5E illustrate bearing plate 402 of FIG. 4 in further example detail, in embodiments. FIGS. 4 and 5A-5E are best viewed together with the following description.

Figure 5A:
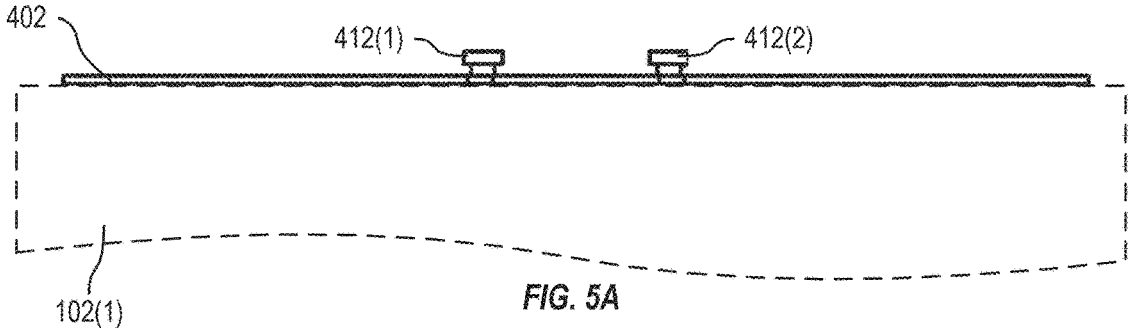
FIGS. 5A-5E illustrate bearing plate of FIG. 4 in further example detail, in embodiments.
Figure 5B:
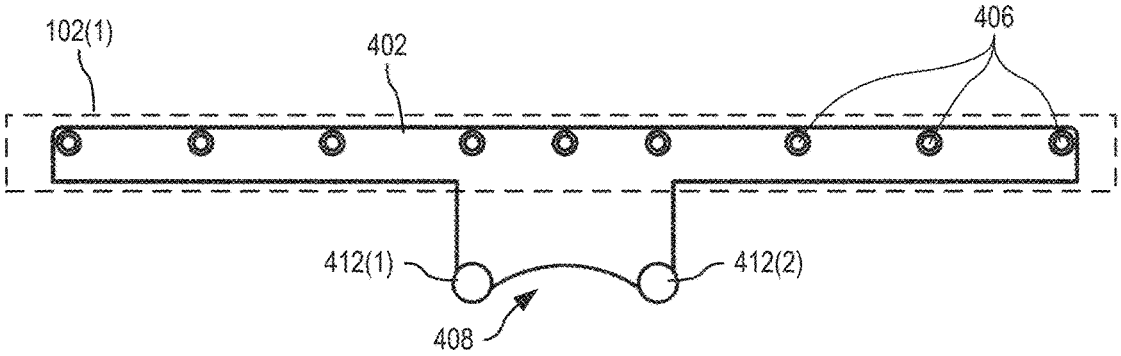
Figure 5C:
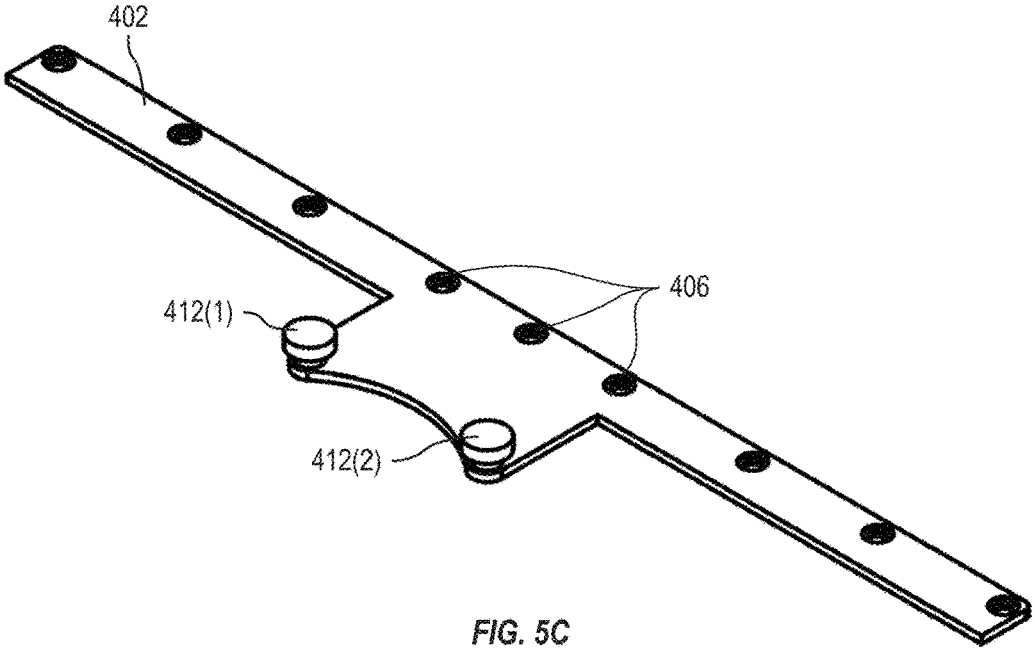
Figure 5D:
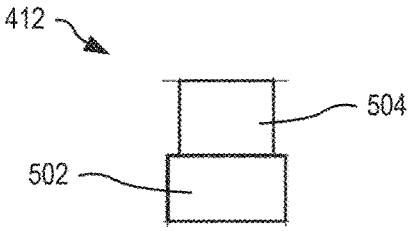
Figure 5E:
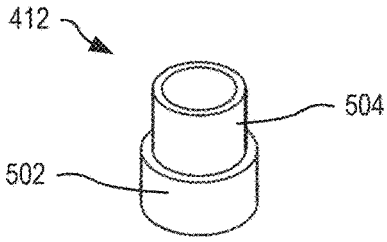

Bearing plate 402 includes a center portion 408 that extends beneath a lower surface 410 of sliding top portion 102(1) and supports two bearings 412(1) and 412(2) mounted to an outside edge of center portion 408. As shown in FIGS. 5D and 5E, each bearing 412 is formed with a rotating outer portion 502 and a spacer 504 that positioned rotating outer portion 502 away from center portion 408 of bearing plate 402, and thus from end 404 of sliding top portion 102(1). The bearing plate on the other end of sliding top portion 102(1) is similarly attached such that rotating outer portions 502 of bearings 412 extend away from sliding top portion 102(1). In certain embodiments, rotating outer portion 502 include ball-bearings.

Figure 6A:
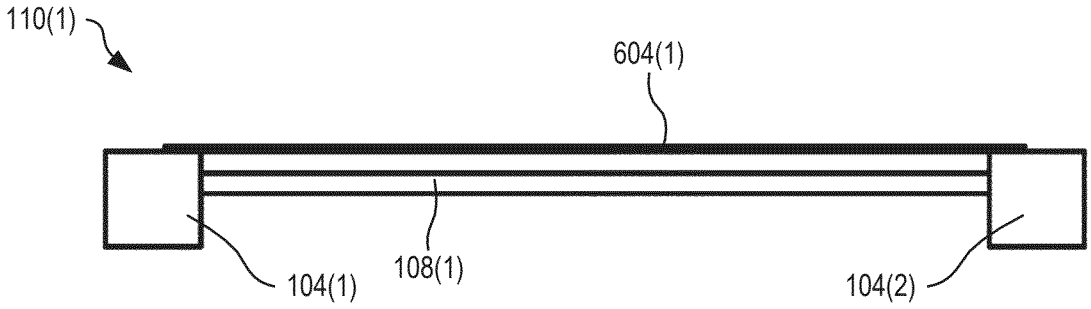
FIGS. 6A, 6B, and 6C illustrate first end assembly of FIG. 1 where first cross-member forms a guide for bearings of FIG. 4, in embodiments.
Figure 6B:
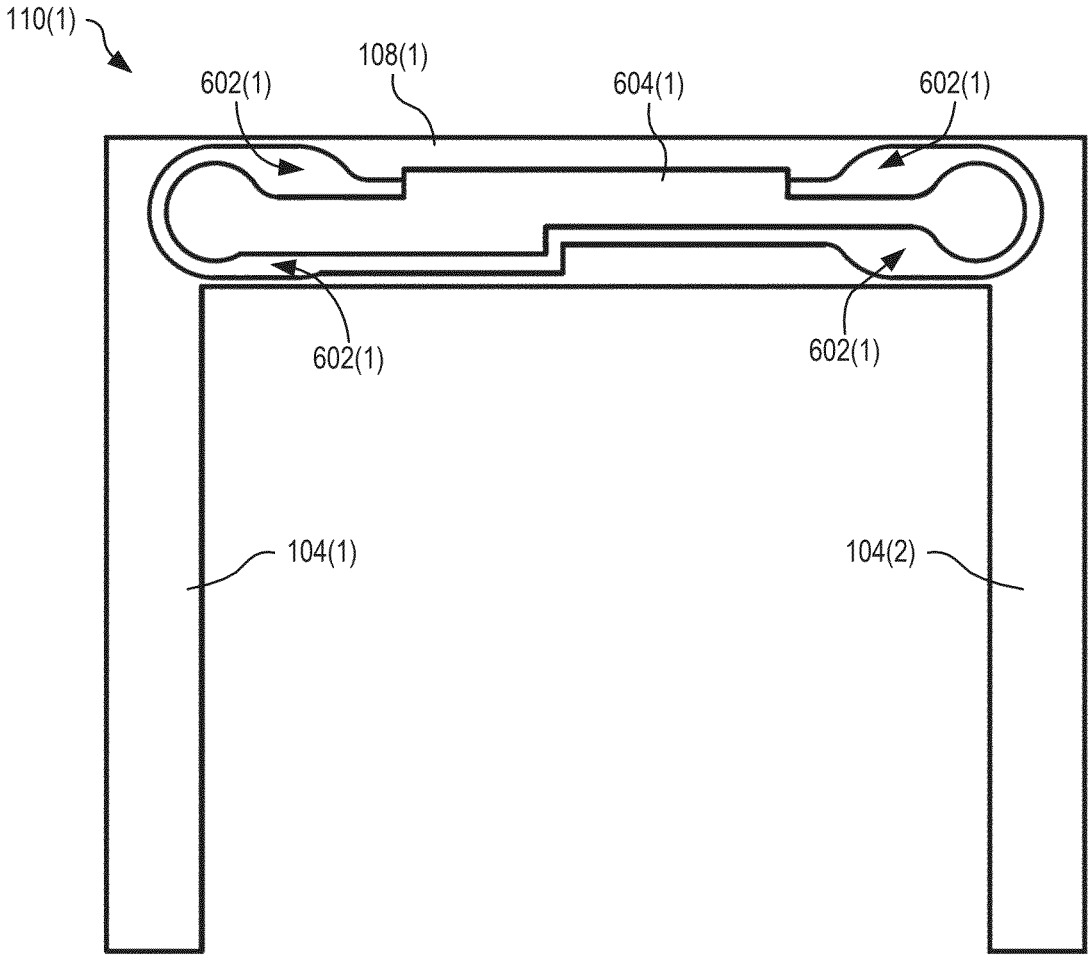
Figure 6C:
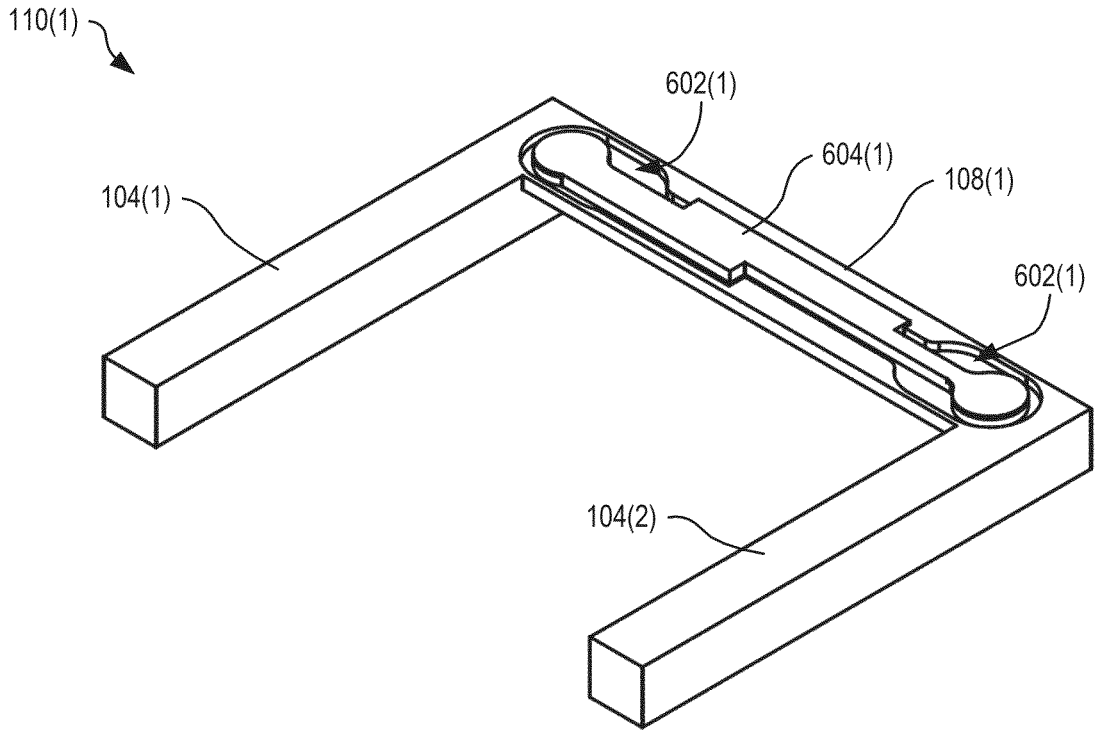

FIGS. 6A, 6B, and 6C illustrate first end assembly 110(1) of FIG. 1 where first cross-member 108(1) forms a guide 602(1) for bearings 412 of FIG. 4, in embodiments. FIG. 6A is a bottom view of first end assembly 110(1), FIG. 6B is an side view of first end assembly 110(1), and FIG. 6C is an isometric view of first end assembly 110(1). FIGS. 6A, 6B, and 6C are best viewed together with the following description.

Although not shown, second end assembly 110(2) forms a guide 602(2) that is a mirror of guide 602(1) about a vertical plane and supports guides bearings 412 of an opposite end of top portions 102. Cross-members 108 and guides 602 are shown in further example detail in FIGS. 8A and 8B. Guides 602 form paths for retaining bearings 412 of top portions 102 that allow each top portion 102(1) and 102(2) to independently transition (e.g., lifted and rotated) between forming top surface 106 and being stored beneath table bottom 208 (e.g., see storage position 900 of FIG. 9).

In certain embodiments, first cross-member 108(1) is formed of a single piece of material (e.g., wood) that is processed (e.g., milled using a numerically controlled machine) to form guide 602(1). For example, a channel with a rectangular cross-section is milled into first cross-member 108(1) to form guide 602(1). Guide 602(1) has a rectangular cross-section sized to receive and allow motion of rotating outer portions 502 of bearings 412(1) and 412(2). In certain embodiments, first cross-member 108(1) is formed of multiple pieces of material that are processed and joined together to form first cross-member 108(1) with guide 602(1). However, first cross-member 108(1) and guide 602(1) may be formed by other wood working methods and techniques without departing from the scope hereof.

Figure 7A:
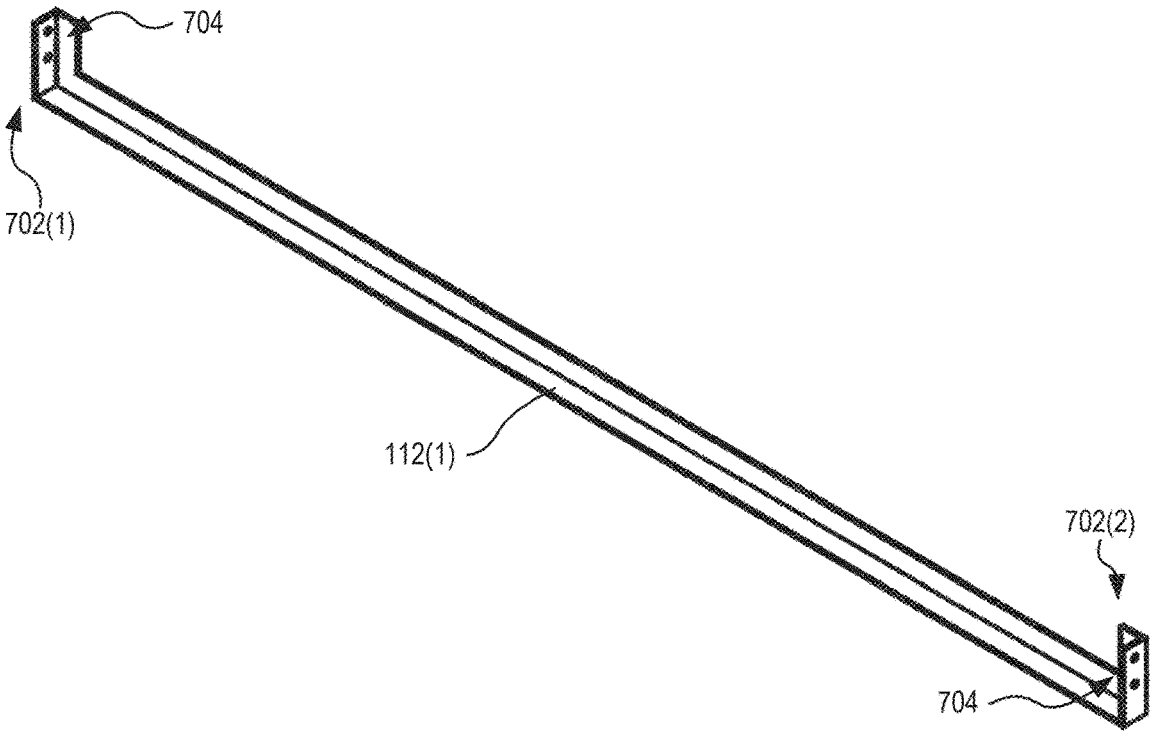
FIG. 7A is an isometric diagram illustrating frame of FIG. 1 in further example detail, in embodiments.

FIG. 7A is an isometric diagram illustrating frame 112(1) of FIG. 1 in further example detail, in embodiments. As shown, frame 112(1) is formed of angle iron with vertical ends 702(1) and 702(2) that each have apertures 704 to receiving fasteners that secure frames 112 to legs 104. Frame 112(2) is similarly formed.

Figure 7B:
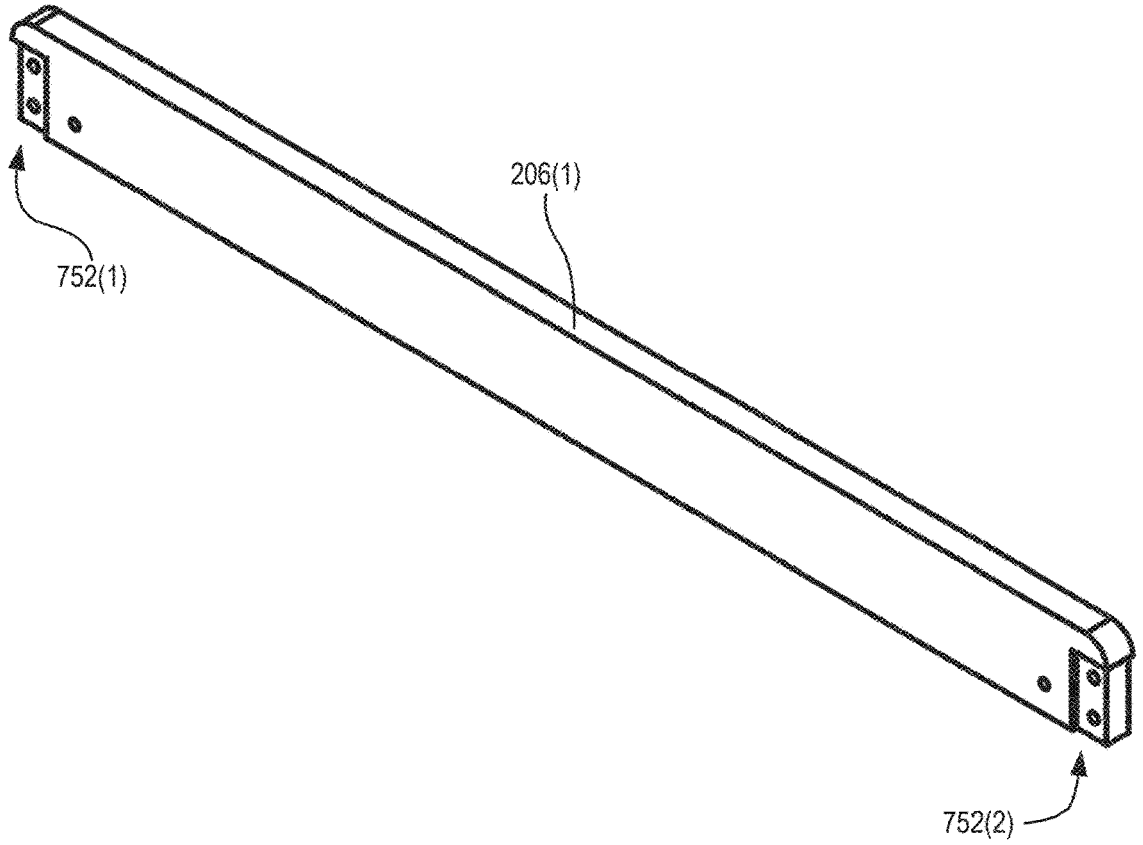
FIG. 7B is an isometric diagram illustrating base-side of FIG. 2 in further example detail, in embodiments.

FIG. 7B is an isometric diagram illustrating base-side 206(1) of FIG. 2 in further example detail, in embodiments. Each end of two base-sides 206(1) forms a recess 752(1) and 752(2) for receiving one vertical end 702(1) of frames 112. Base-side 206(2) is similarly formed.

Figure 8A:
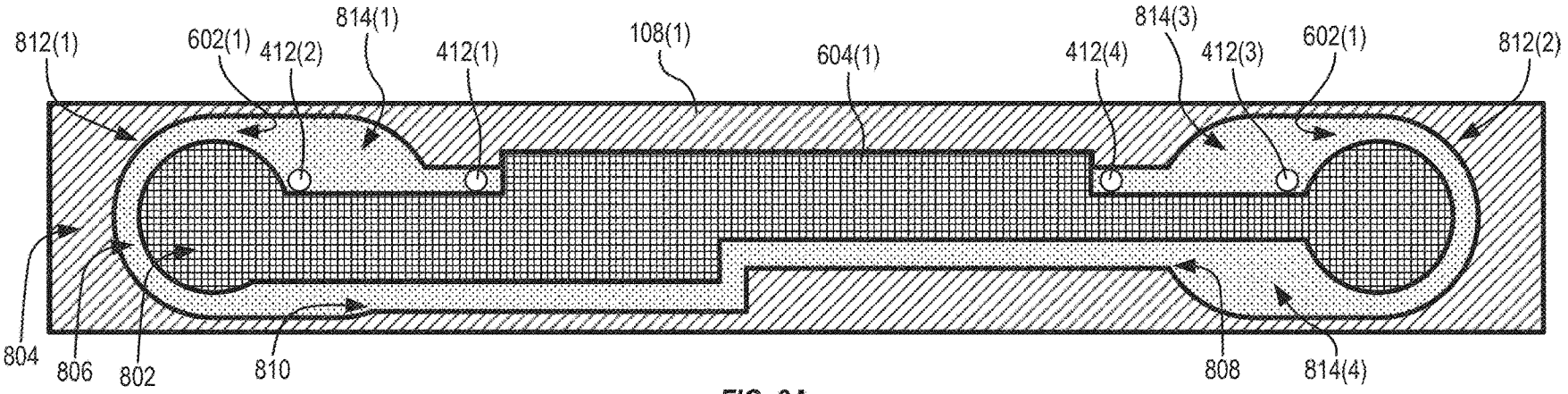
FIGS. 8A and 8B are end views of cross-members illustrating guides of FIGS. 6A, 6B, and 6C in further example detail, in embodiments.
Figure 8B:
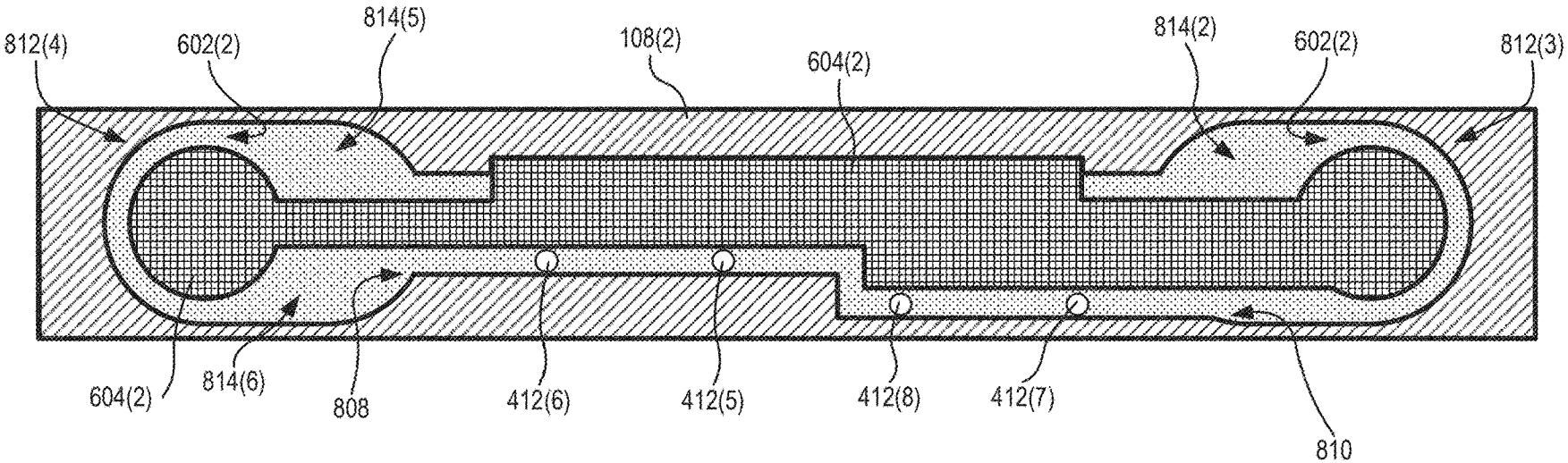

FIGS. 8A and 8B are end views of cross-members 108 illustrating guides 602 of FIGS. 6A, 6B, and 6C in further example detail, in embodiments. FIG. 8A shows guide 602(1) formed in first cross-member 108(1) and FIG. 8B shows guide 602(2) formed in second cross-member 108(2), where guide 602(2) is a mirror of guide 602(1).

Cross-member 108(1) has three planar parallel surfaces: a first surface 802, a second surface 804, and a third surface 806, where third surface 806 is further from first surface 802 than second surface 804. Third surface 806 forms a back wall of guide 602(1). Each surface is represented in a different shading for clarity of illustration and does not necessarily represent a separate component. However, in certain embodiments, a first material is processed to form second surface 804 and third surface 806, and a second material is processed to form first surface 802, where the first and second materials are coupled together to form first cross-member 108(1). Second cross-member 108(2) is similarly formed. Walls of guide 602(2) are substantially perpendicular to third surface 806.

FIG. 8A illustrates positions of bearings 412(1)-412(4) within guide 602(1) of first end assembly 110(1) of FIG. 1 when sliding top portions 102(1) and 102(2) are closed to form top surface 106. FIG. 8B illustrates position of bearings 412(5)-412(8) within guide 602(2) of second end assembly 110(2) of FIG. 1 when sliding top portions 102(1) and 102(2) are stored beneath table 100 to allow access to craft/gaming surface 200. A level 808 of a first lower portion of guide 602 differs from a level 810 of a second lower portion of guide 602 to allow top portions 102(1) and 102(2) to overlap when stored beneath table 100.

Guide 602(1) is formed as semicircular curves 812(1) and 812(2) at either end of cross-member 108(1) where a diameter of each semicircular curve 812(1) and 812(2) is equal to or greater than a spacing of bearing 412 on bearing plate 402. Accordingly, bearings 412 may follow semicircular curves 812 to allow rotation of sliding top portion 102(1) from above table 100 to below table 100. Similarly, guide 602(2) is formed as semicircular curves 812(3) and 812(3) at either end of cross-member 108(2) to allow rotation of sliding top portion 102(2) from above table 100 to below table 100.

Guide 602(1) is formed with a widened area 814(1) and guide 602(2) is formed with a corresponding widened area 814(2) that cooperatively allow lifting of sliding top portion 102(1) to engage bearings 412 into semicircular curves 812(1) and 812(3). Guide 602(1) is also formed with widened areas 814(3) and 814(4) and guide 602(2) is also formed with a corresponding widened areas 814(5) and 814(6) that cooperatively allow lifting of sliding top portion 102(2) to engage bearings 412 into semicircular curves 812(2) and 812(4).

Figure 9:
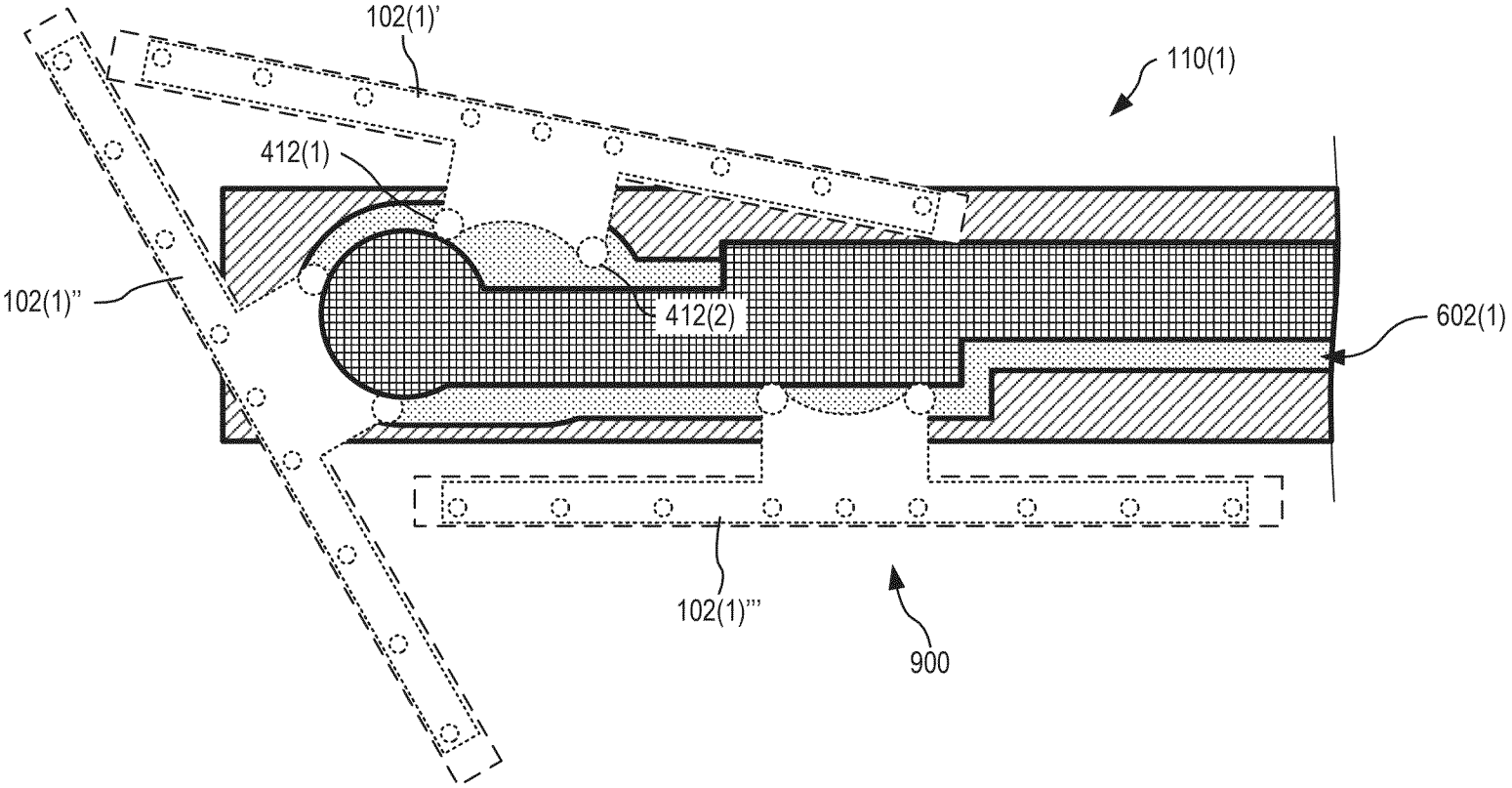
FIG. 9 is a schematic illustrating example operation of the sliding top portion of FIG. 1 within the guide of FIGS. 6A, 6B, and 6C, in embodiments.

FIG. 9 is a schematic illustrating example operation of sliding top portion 102(1) of FIG. 1 within guide 602(1) of FIGS. 6A, 6B, and 6C, in embodiments. Sliding top portion 102(1)' represent lifting of an outside edge of sliding top portion 102(1) to initiate movement of bearings 412(1) and 412(2) around guide 602(1). Sliding top portion 102(1)" represents rotation of sliding top portion 102(1) around a rounded portion of guide 602(1). Sliding top portion 102(1)"' represents positioning of sliding top portion 102(1) at a storage position 900 beneath table 100. Movement of sliding top portion 102(1) is easy and controlled as bearings 412(1) and 412(2) follow a path defined by guide 602(1) in a vertical plane. Advantageously, bearings 412(1) and 412(2) within guide 602(1) support the weight of sliding top portion 102(1) and control motion of sliding top portion 102(1) from the use position of top surface 106 to storage position 900. Particularly, bearings 412(1) and 412(2) on first end and bearings 412(3) and 412(4) on the opposite end control the attitude of sliding top portion 102(1) throughout its travel. Further, bearing plate 402 and bearings 412(1) and 412(2) are captivated in guide 602(1) by a wooden plate 604(1) and bearing plate 402 and bearings 412(3) and 412(4) are captivated in guide 602(2) by a wooden plate 604(2). That is, wooden plate 604(1) and wooden plate 604(2) are sized and shaped to allow movement of sliding top portion 102(1) and sliding top portions 102(2) while retaining bearings 412 within guides 602. Further, center portion 408 of bearing plate 402 slides between first cross-member 108(1) and wooden plate 604(1).

Bearing plate 402 and bearings 412 of sliding top portion 102(2) are similarly captivated by wooden plate 604(2). Accordingly, wooden plates 604(1) and 604(2) prevent sliding top portions 102(1) and 102(2) from falling out and also prevent sliding top portions 102(1) and 102(2) from becoming skewed relative to cross-members 108(1) and 108(2) and table 100. That is, wooden plates 604(1) and 604(2) maintain alignment of sliding top portions 102(1) and 102(2) with respect to first end assembly 110(1) and second end assembly 110(2) to precent binding between first end assembly 110(1) and second end assembly 110(2) when sliding top portions 102(1) and 102(2) are moved.

Alternative Guide Design

Figure 10A:
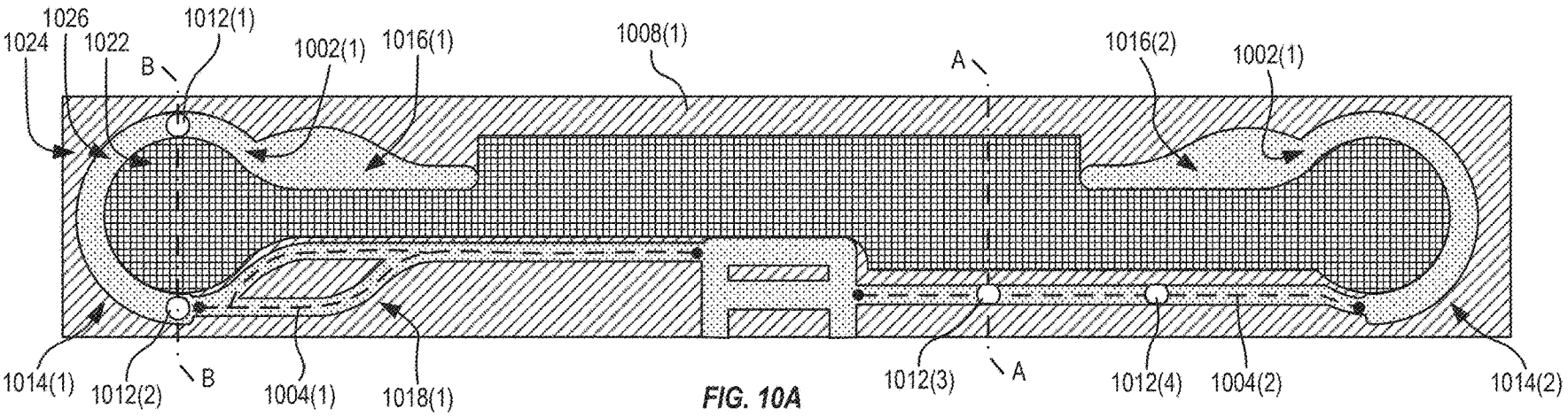
FIGS. 10A and 10B are end views illustrating alternatively formed guides within cross-members, in embodiments.
Figure 10B:
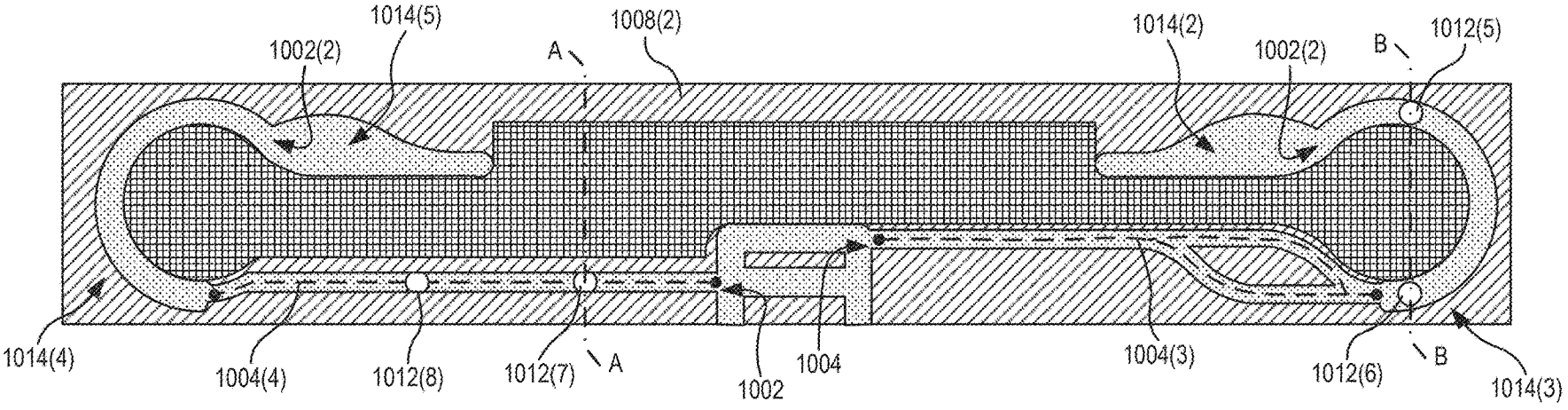
Figure 11A:
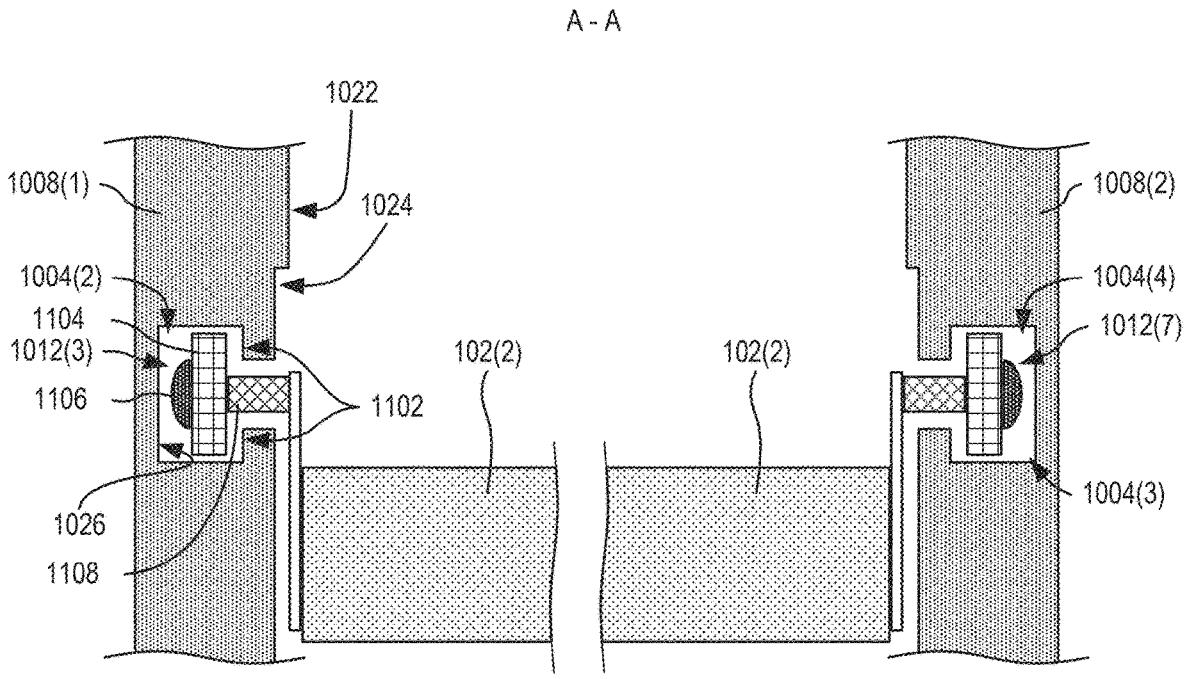
FIG. 11A shows a cross-section A-A of the guides of FIGS. 10A and 10B, in embodiments.
Figure 11B:
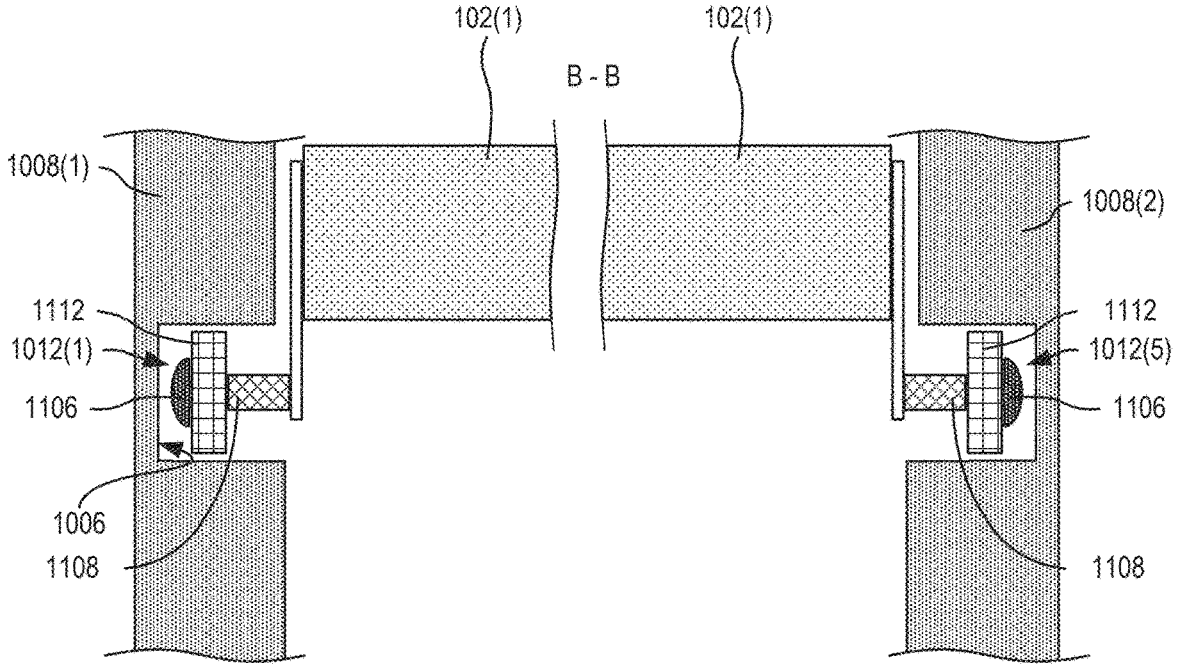
FIG. 11B is a cross-section B-B of the guides of FIGS. 10A and 10B, in embodiments.

FIGS. 10A and 10B are end views illustrating alternatively formed guides 1002(1) and 1002(2) within cross-members 1008(1) and 1008(2), respectively, in embodiments. FIG. 11A is a cross-section through cross-members 1008(1) and 1008(2) of FIGS. 10A and 10B and of top portion 102(2) of FIG. 1 illustrating an undercut portion 1004(1) (indicated by dashed line) of guide 1002(1). FIG. 11B is a cross-section through cross-members 1008(1) and 1008(2) of FIGS. 10A and 10B and of top portion 102(1) of FIG. 1 illustrating rectangular sides of guide 1002(1) without undercut. FIGS. 10A, 10B, 11A, and 11B are best viewed together with the following description. Cross-members 1008 are similar to cross-members 108 of FIG. 1 and may be used in place of cross-members 108 to form table 100. Guide 1002(2) is a mirror of guide 1002(1) about a vertical plane.

Guides 1002 provide similar functionality to guides 602 of FIGS. 6A, 6B, and 6C, and may be formed in a similar way (e.g., milled using a numerically controlled machine) but guide portions 1004 of guides 1002 have a different cross-sectional shape to prevent bearings 1012 leaving the guide in these portions. Guide portions 1004 support bearings 1012 when top portions 102 are stowed beneath table 100. This alternative design of guides 1002 may also facilitate manufacture of cross-members 1008 from a single material using a numerically controlled milling machine. In the example of FIGS. 10A and 10B, cross-member 1008(1) has three planar surfaces: an outer surface 1022 that defines a thickness of cross-members 1008(1), a middle surface 1024 that forms a top edge of guide 1002, and a channel base 1026 that forms a bottom of guide 1002. However, guides 1002 may be formed by other wood working methods without departing from the scope hereof.

Guide 1002(1) is formed as semicircular curves 1014(1) and 1014(2) at either end of cross-member 1008(1) where a diameter of each semicircular curve 1014(1) and 1014(2) is equal to or greater than a spacing of bearing 412 on bearing plate 402. Accordingly, bearings 412 may follow semicircular curves 1014 to guide transition of sliding top portion 102(1) from above table 100 to below table 100. Similarly, guide 1002(2) is formed as semicircular curves 1014(3) and 1014(3) at either end of cross-member 1008(2) to guide transition of sliding top portion 102(2) from above table 100 to below table 100.

Guide 1002(1) is formed with a widened areas 1016(1) and 1016(2) and guide 1002(2) is formed with corresponding widened areas 1016(3) and 1016(4) that cooperatively allow lifting of sliding top portions 102(1) and 102(2) to engage bearings 412 into semicircular curves 1014(1)-(4). Guide 1002(1) is formed with a two-path area 1018(1) and guide 1002(2) is formed with a corresponding two-path area 1018(2) that cooperatively allow lifting of sliding top portions 102(1) and 102(2) to engage bearings 412 into semicircular curves 1014(1) and 1014(3).

FIG. 11A shows a cross-section A-A of guide portions 1004(2) and 1004(4) of guides 1002(1) and 1002(2) supporting bearing 1012(3) and 1012(4), respectively, where sliding top portion 102(2) is positioned beneath table 100. Guide portion 1004(2) is formed with undercuts 1102 such that an outer opening of guide 1002(1) at guide portion 1004(2) has a width that is smaller than an outside diameter of rotating outer portion 1104(1) of bearing 1012(3). Guide portion 1004(4) is similarly formed. Advantageously, guide portions 1004 prevent top portions 102 from skewing and jamming within guides 1002.

FIG. 11B shows a cross-section B-B of portions of guides 1002(1) and 1002(2) external to guide portions 1004(2) and 1004(4), where the channel has a rectangular cross-section, similar to the cross-section of guides 602 of FIGS. 6A, 6B, 6C, 8A, and 8B. As shown, the position of bearings 1012(1), 1012(2), 1012(5) and 1012(6) are a locations where sliding top portion 102(1) is approximately halfway along guides 1002(1) and 1002(2) (e.g., as occurs when sliding top portion 102(1) is being stowed. Accordingly, the portions of guides 1002(1) and 1002(2) that are external to guide portions 1004 are formed with rectangular sides spaced apart by a width slightly larger than a diameter of rotating outer portion 1104 of bearings 1012.

FIGS. 11A and 11B also show bearings 1012 in further example detail. Each bearing 1012 is formed of a rotating outer portion 1104, a screw 1106, and a spacer 1108, where spacer 1108 maintains a distance between rotating outer portion 1104 and top portion 102 into which screw 1106 is screwed. Rotating outer portion 1104 rolls within guides 1002 to control movement of top portions 102.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A table with a split sliding top and a craft/gaming surface, comprising:

a first end assembly having two legs and a first cross-member, the first cross-member forming a first channel in one side of the first cross-member;

a second end assembly having two legs and a second cross-member, the second cross-member forming a second channel in one side of the second cross-member;

a table bottom mounted between the first end assembly and the second end assembly to form the craft/gaming surface;

a first sliding top portion having a first bearing plate and a second bearing plate attached at opposite ends of the first sliding top portion; and a second sliding top portion having a third bearing plate at a first end of the second sliding top portion and a fourth bearing plate at a second end of the second sliding top portion that is opposite to the first end;

wherein two bearings on each of the first bearing plate, the second bearing plate, the third bearing plate, and the fourth bearing plate extend into a corresponding one of the first channel and the second channel to guide the first sliding top and the second sliding top to independently transition the table between use with the split sliding top and the craft/gaming surface, the first channel and the second channel defining paths for the bearings to follow when the first sliding top portion and the second sliding top portion rotate and slide beneath the table for storage.

2. The table of claim 1, further comprising:

a first wooden plate sized and shaped to retain the bearings of the first and third bearing plates within the first channel; and a second wooden plate sized and shaped to retain the bearings of the second and fourth bearing plates within the second channel.

3. The table of claim 2, wherein a center portion of the first and third bearing plates slides between the first wooden plate and the first cross-member and a center portion of the second and fourth bearing plates slides between the second wooden plate and the second cross-member.

4. The table of claim 3, wherein the first and second wooden plates and the first, second, third, and fourth bearing plates maintain alignment of the first sliding top portion and the second sliding top portion when sliding.

5. The table of claim 4, the first and second wooden plates and the first, second, third, and fourth bearing plates preventing binding between the first sliding top portion and the first end assembly and between the second sliding top portion and the second end assembly.

6. The table of claim 1, wherein weight of the first sliding top portion and the second sliding top portion are supported by the bearings and the first and second channels.

7. The table of claim 1, wherein a portion of each of the first channel and the second channel have a cross-section with undercuts that retain the bearings within the channel, wherein other portions of the first channel and the second channel external to the portion with undercuts have a rectangular cross-section.

8. The table of claim 7, wherein the portions of the first channel and the second channel with the undercuts prevent the first sliding top portion and the second sliding top portion from skewing in the first and second channels.

9. The table of claim 1, each of the first channel and the second channel forming two semicircular curves of a diameter greater than a spacing of the bearings on the bearing plate.

10. The table of claim 1, wherein each of the first channel and the second channel forming at least two widened areas that allow lifting of the first sliding top portion and the second sliding top portion.

11. The table of claim 1, further comprising a storage space formed between an underside of the sliding top portions and the craft/gaming surface.

12. A table with a split sliding top and a craft/gaming surface, comprising:

a first end assembly having two legs and a first cross-member, the first cross-member forming a first channel in one side of the first cross-member;

a second end assembly having two legs and a second cross-member, the second cross-member forming a second channel in one side of the second cross-member;

a table bottom mounted between the first end assembly and the second end assembly to form the craft/gaming surface;

a first sliding top portion having a first bearing plate and a second bearing plate attached at opposite ends of the first sliding top portion; and a second sliding top portion having a third bearing plate at a first end of the second sliding top portion and a fourth bearing plate at a second end of the second sliding top portion that is opposite to the first end;

wherein two bearings on each of the first bearing plate, the second bearing plate, the third plate, and the fourth plate extend into a corresponding one of the first channel and the second channel and guide the first sliding top and the second sliding top to independently transition the table between use with the split sliding top and the craft/gaming surface, the first channel and the second channel defining paths for the bearings to follow when the first sliding top portion and the second sliding top portion rotate and slide beneath the table for storage.

13. A table with a split sliding top and a craft/gaming surface, comprising:

a first end assembly having two legs and a first cross-member, the first cross-member forming a first guide;

a second end assembly having two legs and a second cross-member, the second cross-member forming a second guide;

a table bottom mounted between the first end assembly and the second end assembly to form the craft/gaming surface;

a first sliding top portion having a first bearing plate and a second bearing plate attached at opposite ends of the first sliding top portion; and a second sliding top portion having a third bearing plate at a first end of the second sliding top portion and a fourth bearing plate at a second end of the second sliding top portion that is opposite to the first end;

wherein two bearings on each of the first bearing plate, the second bearing plate, the third bearing plate, and the fourth bearing plate extend into a corresponding one of the first guide and the second guide to guide the first sliding top and the second sliding top to independently rotate from a top surface position to a storage position beneath the table.

* * * * *